United States Patent [19]

Arnold et al.

[11] 4,047,981

[45] Sept. 13, 1977

[54] INTERNALLY NITRIDED FERRITIC STAINLESS STEEL STRIP, SHEET AND FABRICATED PRODUCTS AND METHOD THEREFOR

[75] Inventors: Jerry L. Arnold, Franklin; Joseph A. Douthett, Monroe, both of Ohio

[73] Assignee: Armco Steel Corporation, Middletown, Ohio

[21] Appl. No.: 701,089

[22] Filed: June 30, 1976

[51] Int. Cl.[2] ..... C22C 38/40; C21D 1/48

[52] U.S. Cl. ..... 148/16; 75/126 D; 148/37; 148/16.6

[58] Field of Search ..... 148/16.6, 16, 155, 15, 148/37, 12.1, 112; 427/226, 227; 75/126 D

[56] References Cited

U.S. PATENT DOCUMENTS

| | | | |
|---|---|---|---|
| 3,615,904 | 10/1971 | Kindlimann | 148/12.1 |
| 3,632,456 | 1/1972 | Sakakura et al. | 148/112 |
| 3,928,088 | 12/1975 | Schlosser et al. | 148/37 |

FOREIGN PATENT DOCUMENTS

| | | | |
|---|---|---|---|
| 1,407,407 | 9/1975 | United Kingdom | 148/16.6 |

*Primary Examiner*—Walter R. Satterfield

*Attorney, Agent, or Firm*—Melville, Strasser, Foster & Hoffman

[57] ABSTRACT

Internally nitrided ferritic stainless steel cold reduced strip and sheet and products fabricated therefrom having an elevated temperature creep strength and oxidation resistance superior to AISI Type 316 austenitic stainless steel, and good room temperature formability. A non-hardenble AISI Type 400 series ferritic stainless steel containing a nitride former (titanium, zirconium, hafnium, columbium, vanadium, tantalum or rare earth metals) in excess of the amount required to react completely with residual nitrogen and carbon in the steel is reacted with nitrogen internally by heat treatment in a nitrogen-hydrogen atmosphere at a temperature of at least about 800° C but below that at which austenite will form under conditions precluding formation of chromium nitrides, chromium oxides, and austenite.

16 Claims, 1 Drawing Figure

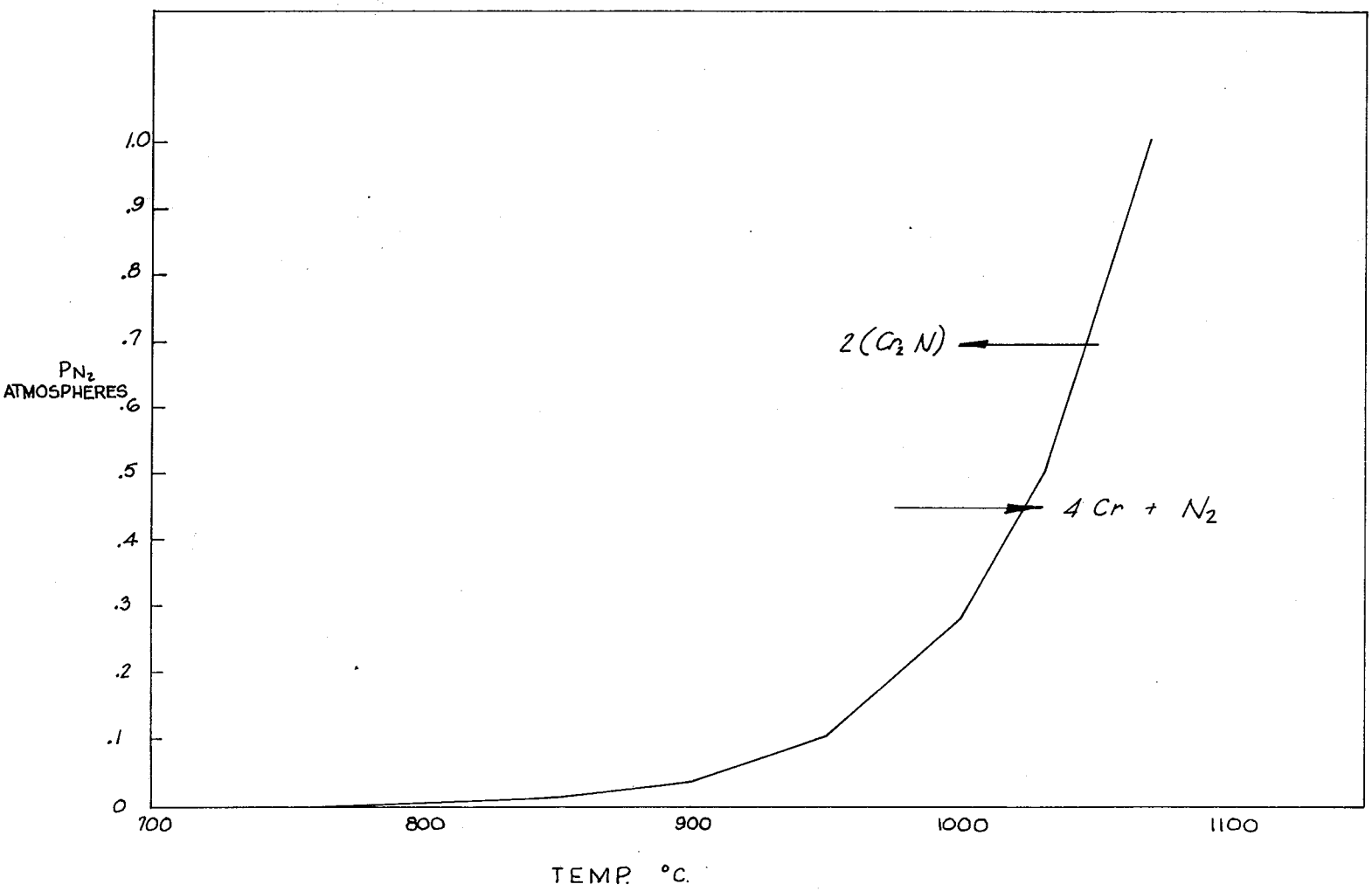
1.0
.9
.8
.7
.6
.5
.4
.3
.2
.1
0
$P_{N_2}$
ATMOSPHERES
700
800
900
1000
1100
TEMP. °C.
$2(Cr_2N)$
$4Cr + N_2$

INTERNALLY NITRIDED FERRITIC STAINLESS STEEL STRIP, SHEET AND FABRICATED PRODUCTS AND METHOD THEREFOR

BACKGROUND OF THE INVENTION

1. Field of the Invention

This invention relates to internally nitrided ferritic stainless steel strip, sheet and fabricated products in cast or wrought form having good creep strength at elevated temperature, while retaining good room temperature formability, and to a process for production thereof. The strip, sheet and fabricated products further exhibit a low coefficient of thermal expansion, good sulfidation resistance and resistance to cyclic high temperature oxidation, these further properties not being possessed by the more expensive austenitic stainless steels. Although not so limited, the steels of the invention thus have utility in applications such as coal gasification, thermal reactors in automotive exhaust systems, gas turbine truck regenerators, early fuel evaporation valves, and the like. The material can thus replace the more expensive austenitic stainless steels in any application where its elevated temperature creep strength and oxidation resistance are equal or superior to those of austenitic stainless steels.

2. Description of the Prior Art

Case hardening by heat treating in an ammonia-containing atmosphere to form an iron-nitrogen structure which is transformed by quenching to produce high surface hardness has been practiced for many years. A typical process relating to nitriding of a "Nitralloy" type steel is disclosed in U.S. Pat. No. 3,399,085, issued Aug. 27, 1968 to H. E. Knechtel et al.

An article in "Heat Treatment of Metals" pages 39–49 (1975) entitled "Ferritic Nitrocarburising", reviews molten salt bath treatments of the cyanide and/or cyanate type, gaseous nitrocarburizing and vacuum nitrocarburizing. All such treatments, when applied to ferritic carbon steels and alloy steels, are indicated to result in formation of an epsilon iron carbonitride phase on the surface which improves tribological properties, fatigue resistance, and wear and anti-scuffing properties.

U.S. Pat. No. 3,847,682, issued Nov. 12, 1974 to Rollin E. Hook, discloses a method of increasing the yield strength of a low carbon steel by heating in an atmosphere comprising ammonia and hydrogen. A deoxidized, low carbon steel containing from about 0.002% to about 0.015% carbon, up to about 0.012% nitrogen, up to about 0.08% aluminum, a nitride-forming element chosen from the group consisting of titanium, columbium, zirconium and mixtures thereof, in amounts such that titanium in solution is from about 0.02% to about 0.2%, columbium in solution is from about 0.025% to about 0.3%, and zirconium in solution is from about 0.025% to about 0.3%, an balance essentially iron, is heat treated at 1100° to 1350° F in an atmosphere containing ammonia in an amount insufficient, at the temperature and time involved, to permit formation of iron nitride. The preferred nitriding atmosphere comprises ammonia-hydrogen mixtures having 3% to 6% by volume ammonia. This patent further discloses that nitrogen taken into solid solution as a result of the alloy-nitrogen precipitation strengthening step can present weldability problems and can result in high ductile-to-brittle Charpy impact transistion temperatures. However, if the nitriding step is followed by a denitriding step, which involves annealing in hydrogen at about 1200° F for at least two hours, the excess nitrogen is removed with a slight reduction in yield strength, thereby eliminating weld porosity and substantially reducing the ductile-to-brittle transistion temperature.

U.S. Pat. No. 3,804,678, issued Apr. 16, 1974 to L. E. Kindlimann, discloses an internally nitrided austenitic stainless steel preferably containing about 0.5% to 3% titanium which is caused to form dispersed nitride particles having an interparticle spacing of less than 10 microns, by nitriding within the range of 1600° F to the melting point of the steel in an ammonia-or-nitrogen-containing atmosphere at super-atmospheric pressure. The balance of the atmosphere comprises a non-oxidizing or inert gas such as hydrogen or argon.

Other nitride formers disclosed in the Kindlimann patent are aluminum, vanadium, columbium, boron, zirconium, etc., but titanium is stated to be greatly preferred.

While the case hardening of ferritic stainless steel has been practiced in the prior art, and while the above-mentioned Hook and Kindlimann patents disclose the internal nitriding of low carbon steel and austenitic stainless steel, respectively, to the best of applicants' knowledge no previous attempts to subject ferritic stainless steels to internal nitriding have been successful in improving the elevated temperature properties thereof to a degree equal or superior to those of austenitic stainless steels. In view of the relatively high cost of austenitic stainless steels, and periodic scarcities of nickel, it is evident that there is a definite need for a relatively inexpensive non-nickel bearing material which exhibits good creep strength at elevated temperature and good elevated temperature oxidation resistance, together with good room temperature formability.

SUMMARY

It is a principal object of the present invention to provide a material having the above combination of properties, in the form of internally nitrided ferritic stainless steel strip, sheet or fabricated products in cast and/or wrought form which is relatively inexpensive by reason of a low level of alloying elements other than chromium.

It is a further object of the invention to provide a simple and reliable process for the production of internally nitrided ferritic stainless steel strip, sheet and fabricated products in cast or wrought form.

In its broadest aspect the present invention provides internally nitrided ferritic stainless steel cold reduced strip and sheet and products fabricated therefrom comprising a substantially fully ferritic stainless steel composition such as the non-hardenable AISI Type 400 series, containing a nitride former chosen from the group consisting of titanium, zirconium, hafnium, columbium, vanadium, tantalum, and rare earth metals, the nitride-forming element being in excess of the amount required to react completely with residual nitrogen and carbon in the steel, the excess nitride former being reacted with nitrogen internally to a depth sufficient to obtain a creep strength, and oxidation resistance superior to those of AISI Type 316 austenitic stainless steel at elevated temperatures (i.e., above 870° C). It is essential that there be no chromium nitrides in the final product and that the steel be substantially fully ferritic (e.g., less than about 5% austenite) prior to, during and after the nitriding treatment.

A preferred composition for starting materials which may be nitrided by the process of the invention ranges, in weight percent, from about 16% to about 26% chromium, from about 0.4% to about 1.2% silicon, from about 0.4% to about 2% total titanium (about 0.25% to about 1.25% soluble titanium), residual carbon, nitrogen, phosphorus, sulfur, nickel, aluminum, and molybdenum, and balance iron. Where good formability is not needed, such as in a cast product, the silicon content of the above composition may be increased to 3% or even 5%.

The method of producing internally nitrided ferritic stainless steel in accordance with the invention comprises the steps of providing a cold reduced substantially fully ferritic non-hardenable AISI Type 400 series stainless steel in the form of strip, sheet or fabricated products containing a nitride former of the type and in the amounts set forth above, and subjecting the strip, sheet or fabricated products to a nitriding heat treatment in a nitrogen-hydrogen atmosphere at a temperature of at least about 800° C but below the temperature at which austenite will form, controlling the nitrogen partial pressure and dew point of said atmosphere, the temperature, and the composition of said steel in such manner as to avoid formation of chromium nitride, chromium oxide, and austenite, for a period of time sufficient to cause at least about 75% by weight of the excess nitride former to combine with the nitrogen in the treatment atmosphere in the form of microscopic, uniformly dispersed nitrides.

It has been found that the following basic concepts govern the processing parameters in accordance with the invention:

To avoid formation of austenite the amount of ferrite stabilizers such as chromium and silicon should be in the upper portions of the ranges set forth above, while austenite stabilizers such as carbon, manganese, nickel and the nitrogen partial pressure should be kept at low levels. Operating in the lower portion of the temperature range set forth above also tends to avoid austenite formation. These three factors are interrelated since relatively high chromium and silicon contents and/or relatively low carbon, manganese and nickel contents will permit heat treatment at a relatively high temperature and/or nitrogen partial pressure without forming austenite.

In order to avoid chromium nitride formation the chromium content should be maintained in the lower portion of the range set forth above, a relatively low nitrogen partial pressure should be used, and a relatively high temperature should be used.

In order to avoid formation of chromium oxide, the chromium content should be in the lower portion of the range set forth above, the oxygen content and the dew point of the treatment atmosphere should be low, the hydrogen content of the atmosphere should be high, and a relatively high treatment temperature should be used.

For maximum nitriding kinetics, i.e., rapid nitriding rate, the content of the nitride former should be maintained within the lower portion of the range set forth above; the chromium content should be in the upper portion of the range; a purposeful manganese addition may be made; silicon and nickel should be restricted to low levels; the nitrogen partial pressure should be relatively high in order to increase soluble nitrogen at the surface; the nitriding temperature should be within the upper portion of the range set forth above; and the dew point and oxygen content of the treatment atmosphere should be kept low enough to prevent formation of a surface barrier layer of any oxides.

By way of further explanation, chromium and manganese tend to increase, while silicon and nickel tend to decrease, the soluble nitrogen at the surfaces for a given treatment temperature and nitrogen partial pressure of treatment atmosphere.

It should further be noted that increasing the nitrogen partial pressure of the atmosphere above that which would result in chromium nitride formation would not further increase the soluble nitrogen and would not further decrease the time for through thickness nitriding, even though the rate of total nitrogen pick-up would increase.

An increase in the nitriding temperature both increases nitrogen solubility and nitrogen diffusivity.

From the standpoint of properties, optimum oxidation resistance is obtained by maintaining the chromium and silicon contents in the upper portion of the ranges set forth above.

For optimum elevated temperature strength the volume fraction of internal nitrides should be high, and the size and spacing of internal nitrides should be small. In general, an increase in the rate at which the internal nitride reaction moves through the strip or sheet will decrease the size of the precipitates which are formed. The reaction moves in the manner of a front, and the motion is a parabolic function of time. Hence, the precipitates at the surface are always smaller in size than those in the center of a strip or sheet. Additionally, the higher the nitriding temperature, the coarser the precipitate tends to be. Thus, the faster rate of reaction front movement due to an increase in temperature is usually offset by a higher coarsening rate of the precipitates.

For optimum formability at room temperature, the volume fraction of internal nitride precipitates should be kept low, and the size and spacing of the precipitates should be increased. Formability is also improved by maintaining low chromium and silicon contents and minimizing excess nitrogen in solution.

For an optimum combination of properties and ease of processing a more preferred range of starting material comprises about 19% to about 21% chromium, about 0.4% to about 0.7% silicon, about 0.25% to about 0.6% soluble titanium, residual carbon, nitrogen, manganese, phosphorus, sulfur, nickel, aluminum and molybdenum, and balance iron. After nitriding in accordance with the process of the invention, at least about 0.07% by weight nitrogen is added in the form of titanium nitride if the minimum content of 0.25% soluble titanium in the steel is fully combined with nitrogen, the stoichiometric ratio of titanium to nitrogen being 3.42:1.

Complete through-thickness nitriding is not essential in the practice of this invention. For some types of bending or forming operations it is advantageous to produce nitrided surface layers and retain a central core which is not nitrided and hence more ductile than the outer layers. However, the depth to which nitrogen penetrates (beneath both surfaces) is under all circumstances greater than that of conventional case-hardening by nitriding or nitrocarburizing.

BRIEF DESCRIPTION OF THE DRAWING

Reference is made to the sole FIGURE which is a graphic representation of the relation of nitrogen partial pressure and temperature to the equilibrium between chromium nitride and chromium in solution in a 20% by weight chromiumiron alloy.

DESCRIPTION OF THE PREFERRED EMBODIMENTS

The nitride-forming element must be added in an amount in excess of that which will react with the residual carbon, nitrogen and oxygen in the molten steel. In the case of the preferred nitride-former titanium, it will thus be added in an amount greater than: about 4 times the percentage of carbon, about 3.4 times the percentage of nitrogen and about 3 times the percentage of oxygen. Preferably, the total titanium content will be at least six times the sum of the carbon, nitrogen and oxygen contents of the hot rolled or cold rolled and annealed material. As indicated above, the amount of nitride-former present in uncombined form, i.e., in solid solution, may be varied in order to obtain a desired balance of increased creep strength at elevated temperature with room temperature formability, and time of nitriding treatment. A high titanium content increases the elevated temperature creep strength but decreases room temperature formability, and increases the nitriding time. From the standpoint of elevated temperature creep strength, at least 0.1% soluble titanium should be present, and optimum improvement is obtained within the range of about 0.5 to about 1% soluble titanium. At the opposite extreme, more than about 1.25% soluble titanium decreases room temperature formability, and unduly lengthens the nitriding time. Where strip and sheet material will be subsequently fabricated after nitriding by bending and forming operations, it is preferred to observe a maximum of about 0.6% soluble titanium. On the other hand, where an article is to be fabricated into its final configuration, as by bending, forming and/or forging, prior to the nitriding treatment, then the soluble titanium content may advantageously be increased to about 1% or even 1.25% by weight.

A high chromium content improves elevated temperature oxidation resistance and has been found to increase the nitriding rate, i.e., to decrease the time required for nitriding. On the other hand, a high chromium level increases nitrogen solubility and the tendency to form chromium nitrides. For optimum high temperature oxidation resistance a chromium level of at least 17.5% with a silicon level of about 1% is preferred, or a chromium level of at least about 19% with silicon less than 1%. For minimum nitrogen pick-up and tendency to form chromium nitrides, a maximum of about 20.5% chromium should be observed, unless nitriding at a relatively high temperature is contemplated.

A high silicon content improves elevated temperature oxidation resistance, and decreases nitrogen solubility. On the other hand, high silicon decreases the nitriding rate. An optimum balancing of these effects is thus obtained within the range of about 0.4% to about 0.7% silicon.

A stainless steel melt may be prepared by any conventional practice, cast in the form of ingots or slabs, hot rolled at a starting temperature of about 1100° to about 1300° C, pickled or grit blasted to remove hot mill scale, cold reduced (e.g., about 50%), and annealed at about 800° to about 1100° C.

The cold rolled strip or sheet material may then be prepared for nitriding, or articles may be fabricated therefrom by bending, forming, or forging operations, and the fabricated article may be nitrided in its final configuration.

Surprisingly, it has been found that the nitriding rate is increased if a scale formed by a continuous air anneal is permitted to remain on the surfaces during the nitriding operation. Since such a practice eliminates pickling and/or grit blasting, this is the preferred practice of the process. Moreover, it has been found that the presence of scale on the surfaces minimizes the adverse effect of contaminants in the nitriding atmosphere.

Although not wishing to be bound by theory, it is believed that the scale formed by a continuous air anneal, which is composed predominantly of chromium oxide and iron oxide with a dispersed minor phase of uniformly distributed silicon and titanium oxides therein, is reduced to metallic iron and chromium by the hydrogen in the nitriding atmosphere, thus providing a freshly formed matrix at pure metal into which the nitrogen in the nitriding atmosphere diffuses rapidly. While the titanium and silicon oxides in the relatively thin scale are not reduced, these particles are dispersed in the iron and chromium matrix and hence do not form a barrier against inward diffusion of nitrogen.

The strip or sheet, or article formed therefrom, are then subjected to nitriding at a pressure of about one atmosphere, the nitriding atmosphere preferably comprising up to about 2% by volume nitrogen and balance essentially hydrogen, with a dew point not higher than about −15° C and preferably about −45° C. The oxygen content of the atmosphere should also be maintained at the practical minimum, although as indicated above, the presence of a scale on the surface prior to nitriding makes the method more tolerant to the presence of minor amounts of impurities such as oxygen and water vapor.

The nitriding heat treatment should be conducted at a minimum of about 800° C since lower temperatures unduly prolong the nitriding time and promote chromium nitride and chromium oxide formation. On the other hand, the temperature cannot exceed that at which austenite would start to form. A temperature range of about 900° to about 950° C is preferred.

The nitriding anneal time at temperature may range from about 5 to about 120 hours. This relatively wide variation is dependent upon strip or article thickness, temperature, chromium, titanium and silicon contents, and upon whether complete through-thickness nitriding is desired.

Referring to the graph of the drawing, the standard free energy ($\Delta\sigma°$) of the reaction $$2Cr_2N \rightleftarrows 4\,Cr + N_2$$

equal 51, 900 + 11.5 T log T − 66T, The equation for calculation of standard free energy is:

$$\Delta\sigma° = -RT\ln\frac{A_{Cr}^4 \times p_{N2}}{A_{Cr_2N}^{\ 2}} \quad (1)$$

Assuming that the $Cr_2N$ phase is present as a pure compound (i.e., $A_{Cr_2N} = 1$), assuming the activity of chromium to be given by $$A_{Cr} = \gamma_{Cr}\,\alpha \cdot X_{Cr},$$

and assuming 20% by weight chromium with balance iron (i.e., $X_{Cr} = 0.212$), an activity coefficient may be applied taken from the data of Mazandarany & Pehlke (1973) in the form $\lambda_{Cr\,\alpha} = 0.333 \exp(4180/RT)$.

To solve, set the above standard free energy value (51,900 + 11.5 T log T −66T) equal to equation (1) above and insert desired $P_{N_2}$ and $A_{Cr_2N} = 1$. By trial and error, pick values of T; calculate $\gamma_{Cr\,\alpha}$ and find the temperature which causes equation (1) to be equal to the above standard free energy value. Equilibrium data calculated in this manner are plotted in the graph of the drawing. It will of course be recognized that this graph is only a guide to show the general expected behavoir, in view of the above assumptions and the composition of the alloy. Changes in the chromium content, and titanium and silicon additions, would probably cause the curve to shift to the right or left.

A series of laboratory heats was melted and cast into ingots, and subjected to laboratory processing to obtain cold rolled sheets having a final thickness of 0.050 inch. All ingots were hot rolled to about 0.10 inch thickness from a starting temperature of 1150°-1180° C, descaled by grit blasting or pickling, and cold reduced 50% to 0.050 inch thickness. Some of the sheets were then subjected to an air anneal at 900°-950° C, while some were subjected to nitriding without annealing. Some of the annealed specimens were descaled by grit blasting while others were nitrided with the annealing scale on the surfaces.

point. The treatment comprised purging the furnace with nitrogen, introducing the nitriding atmosphere, heating to nitriding temperature (about 8 hours), soaking for time calculated to nitride completely, and denitriding (48 hours in pure hydrogen), furnace cooling to less than 150° C (about 20 hours).

The compositions of the heats prior to nitriding are set forth in Table I. Nitriding conditions and resulting theoretical nitride contents are set forth in Table II. Room temperature mechanical properties are set forth in Table III.

It will be noted from Table I that the chromium, titanium and silicon contents were varied, and that Heat E contained a purposeful addition of aluminum, thus placing it outside the scope of the present invention.

Referring to Table II, nitriding conditions were followed commensurate with through-thickness nitriding. In Heats D and F chromium nitrides were formed, thus placing these heats outside the process of the invention. It will be noted that those heats containing relatively high levels of soluble titanium required relatively long nitriding times.

Excess nitrogen levels relatively low for all heats except Heat E containing 0.96% aluminum. The value of 0.41% excess nitrogen for Heat E was believed to be indicative of aluminum nitride formation. This heat was not completely nitrided due to extremely slow reaction kinetics caused by high aluminum.

TABLE I

Heat Analysis — Unnitrided Internally Nitrided Ferritic Stainless

| Heat | %C | %Mn | %P | %S | %Si | %Cr | %Ni | %Ti | %Al | %N |
|---|---|---|---|---|---|---|---|---|---|---|
| A | .021 | .24 | .023 | .017 | .61 | 19.89 | .36 | .98 | — | .021 |
| B | .020 | .24 | .023 | .016 | 1.98 | 19.65 | .35 | .80 | — | .024 |
| C | .024 | .23 | .022 | .012 | .99 | 20.03 | .36 | .90 | — | .015 |
| D | .018 | .23 | .020 | .014 | .87 | 18.95 | .34 | 1.31 | — | .0098 |
| E | .028 | .27 | .023 | .015 | .93 | 17.87 | .36 | 1.20 | .96 | .016 |
| F | .068 | .23 | .012 | .018 | .50 | 20.41 | .22 | .96 | — | .011 |
| G | .063 | .21 | .012 | .019 | 1.04 | 19.43 | .23 | .75 | — | .014 |
| H | .055 | .23 | .015 | .014 | .42 | 16.52 | .34 | .69 | — | .019 |

TABLE II

Nitriding Conditions & Analysis Internally Nitrided Ferritic Stainless

| | Alloy Composition | | | | Nitriding Conditions | | | | | |
|---|---|---|---|---|---|---|---|---|---|---|
| Heat | %Cr | %Ti | Soluble %Ti(1) | %Si | Temp. | Time | %Total Nitrogen | N as TiN(2) | Excess N(3) | Micro Cr Nitrides |
| A | 19.9 | .98 | .77 | .61 | 905° C | 122.5 hrs. | .22 | .22 | 0 | No |
| B | 19.6 | .80 | .57 | 1.98 | 955° C | 33 hrs.(4) | .20 | .17 | .03 | No |
| C | 20.0 | .90 | .70 | .99 | 905° C | 86.5 hrs.(4) | .24 | .20 | .04 | No |
| D | 19.0 | 1.31 | 1.18 | .87 | 900° C | 126 hrs.(4) | .39 | .34 | .05 | Yes |
| E | 17.9 | 1.20 | 1.01 | .93 (.96%Al) | 955° C | 75 hrs.(4) | .70 | .29 | .41 | No |
| F | 20.4 | .96 | .62 | .50 | 900° C | 87.5 hrs. | .31 | .155 | .145 | Yes |
| G | 19.4 | .75 | .42 | 1.04 | 900° C | 56 hrs. | .16 | .105 | .04 | No |
| H | 16.5 | .69 | .38 | .42 | 900° C | 85 hrs. | .15 | .095 | .035 | No |

(1)Ti available to form internal nitrides
(2)Assumes all soluble Ti after $TiO_2$, TiN, TiC forms from the melt forms internal Ti nitrides
(3)Includes N in the form of soluble N, Cr nitrides or Al nitrides
(4)Nitrided with scale intact Nitriding was carried out in a 1% nitrogen-99% hydrogen (by volume) atmosphere of about −35° C dew-

TABLE III

Nitrided Mechanical Properties-Nitrided Ferritic Stainless steel (Average of Duplicate Tests)

| | Composition | | | | | | | | Minimum Bend (Diameter) | |
|---|---|---|---|---|---|---|---|---|---|---|
| Heat | %Cr | %Ti | %Si | Condition | .2%Y.S. (ksi) | U.T.S. (ksi) | %El (2") | Hard. RB | Long | Trans. |
| A | 19.9 | .98 | .61 | as ann. | 48.8 | 73.6 | 30.0 | 83.0 | — | — |
| | | | | as nit. | 44.5 | 72.0 | 23.0 | 85.0 | 180° - Flat | 180° - 3T |
| B | 19.6 | .80 | 1.98 | as ann. | 66.1 | 89.9 | 25.0 | 91.5 | — | — |
| | | | | as nit. | 62.0 | 85.6 | 10.0 | 93.0 | 180° - 4T | 70° |
| C | 20.0 | .90 | .99 | as ann. | 54.6 | 78.6 | 29.0 | 85.0 | — | — |
| | | | | as nit. | 49.0 | 77.2 | 23.0 | 87.0 | 180° - 10T | 180° - 5T |

TABLE III-continued

Nitrided Mechanical Properties-Nitrided Ferritic Stainless steel (Average of Duplicate Tests)

| Heat | Composition %Cr | %Ti | %Si | Condition | .2%Y.S. (ksi) | U.T.S. (ksi) | %El (2") | Hard. RB | Minimum Bend (Diameter) Long | Trans. |
|---|---|---|---|---|---|---|---|---|---|---|
| D | 19.0 | 1.31 | .87 | as ann. | 55.6 | 80.2 | 28.5 | 85.5 | — | — |
| | | | | as nit. | 50.5 | 89.7 | 18.0 | 90.0 | 70° | 120° |
| E | 17.9 | 1.20 | .93 | as ann. | — | — | — | — | — | — |
| | | | (.96%Al) | as nit. | 46.9 | 79.2 | 19.0 | 87.0 | 180° - 3T | 90° |
| F | 20.4 | .96 | .50 | as ann. | 46.2 | 69.4 | 31.0 | 80.0 | — | — |
| | | | | as nit. | 47.1 | 82.0 | 22.0 | 86.0 | 180 - 1½T | 120° |
| G | 19.4 | .75 | 1.04 | as ann. | 47.3 | 71.5 | 28.0 | 81.5 | — | — |
| | | | | as nit. | 47.8 | 78.1 | 20.5 | 82.5 | 180° - 1T | 180° - 3T |
| H | 16.5 | .69 | .42 | as nit. | 37.4 | 65.4 | 21.0 | 82.0 | 180° - ½T | 180° - ½T |

Referring to Table III, it will be noted that room temperature yield and tensile strengths were not substantially changed as a result of nitriding, except for Heats D and F containing chromium nitride wherein increases in tensile strengths were obtained of about 9.5 and 11.5 psi, respectively.

Formability as determined by percent elongation and bend tests showed a decrease as a result of nitriding, the reduction being in proportion to the silicon and soluble titanium contents. Heat B, containing 1.98% silicon, exhibited an unacceptably low percent elongation of 10.0% after nitriding. However, it will be noted that Heats A, C, G and H within the scope of the invention exhibited entirely adequate formability as measured by elongation values and bend tests.

Hardness values of the nitrided material showed a slight increase, as would be expected.

As an indirect determination of elevated temperature creep strength, sag tests were conducted at 982° C (1800° C) on nitrided specimens of Heats A-H. For purposes of comparison unnitrided specimens of commercial heats of austenitic stainless steels AISI Type 316, Type 310 and TypeRA330 were subjected to the same tests. The results are summarized in Table IV. It will be evident that the steels of the present invention are greatly superior to Type 316, and that the steel of the invention exhibiting the best results (Heat C) was superior to Type 310 and RA330. For best high temperature creep strength, a silicon content of about 1% in combination with a soluble titanium content of about 0.5% to about 0.76% should be observed. It should be further noted that Heat E containing about 1% aluminum exhibited relatively poor elevated temperature strength in comparison to the better heats of the steels of the invention.

As indicated previously, high temperature strength of nitrided material is affected by the size of the nitride precipitates, with smaller sized precipitates resulting in higher strengths. Since precipitate size decreases with increased nitriding rate (i.e., decreased nitriding time) higher strengths may be achieved by restricting the soluble titanium content to a maximum of about 0.75%, and nitriding with a surface scale, since these measures tend to increase nitriding rates.

Cyclic high temperature oxidation resistance tests were conducted on specimens of Heats A-H and on specimens of austenitic stainless steels type 316, Type 310, and RA330, for purposes of comparison. For Heats A-E specimens were tested both in the nitrided and unnitrided conditions. It is evident from a consideration of Heats A-E (Table V) that nitriding did not substantially affect the high temperature oxidation resistance, with the exception of Heat D which contained chromium nitrides as a result of the nitriding operation. On the other hand, Heat F, which also contained chromium nitrides, showed relatively good oxidation resistance, althouh it should be noted that a maximum gain of 8.1 mg was reached after 282 cycles, whereas after 524 cycle the weight gain decreased to 2.2 mg. This indicated some incipient spalling of the surface which was confirmed by visual observation. The final weight gain after 524 cycles of only 2.2 mg is thus not indicative of excellent oxidation resistance with respect to Heat F.

The nitrided ferritic steels of the invention were clearly superior to the austenitic steels, even RA330, which showed a weight loss after 1019 cycles indicative of spalling.

It is further evident that oxidation resistance increased with increasing chromium and/or silicon contents. A chromium content of greater than about 17.5% with a silicon content of about 1% confers good high temperature oxidation resistance, while a chromium content greater than 20% confers good oxidation resistance at silicon contents ranging between about 0.5% and 0.8%.

After oxidation testing, chemical analyses and bend tests were conducted on the test specimens of Heats A-E and the austenitic stainless steel specimens. As reported in Table VI relatively little carbon pick-up occurred from the oxidation testing in a gas fired furnace. The oxygen levels increased generally from about 0.25–0.30% as a result of analyzing with the scale intact. The nitrogen pick-up varied between 0.004–0.301%. The ferritic steels with good oxidation resistance exhibited less than 0.10% increase in nitrogen content. Heat D which contained chromium nitrides and exhibited extremely poor oxidation resistance, underwent a nitrogen pick-up of about 0.25% during the cyclic tests. It appears that during destructive oxidation of ferritic stainless steels, the nitrogen levels increase due to additional chromium nitride formation. Unnitrided Heat E containing about 1% aluminum, also increased about 0.30% in nitrogen level during the oxidation tests, which was probably due to aluminum nitride and titanium nitride formation.

TABLE IV

982° C Sag Tests
Internally Nitrided Ferritic Stainless

| Heat | Chemistry %Cr | %Ti | %Si | Hours of Exposure 2.5 | 3.5 | 5 | 20.5 | 32 | 44.5 | 68.5 | 95 | 108.5 | 112.5 | 132.5 | 182.5 |
|---|---|---|---|---|---|---|---|---|---|---|---|---|---|---|---|
| | | | | Deflection (mils) | | | | | | | | | | | |
| A | 19.9 | .98 | .61 | 46 | — | 61 | 85 | — | 104 | 128 | — | — | — | 187 | — |
| B | 19.6 | .80 | 1.98 | 18 | — | 24 | 28 | — | 37 | 48 | — | — | — | 68 | — |
| C | 20.0 | .90 | .99 | 16 | — | 22 | 29 | — | 41 | 47 | — | — | — | 73 | — |
| D | 19.0 | 1.31 | .87 | 32 | — | 44 | 66 | — | 91 | 109 | — | — | — | 135 | — |
| E | 17.9 | 1.20 | .93 (.96%Al) | 37 | — | 60 | 85 | — | 110 | — | — | 143 | — | — | — |
| F | 20.4 | .96 | .50 | — | 85 | — | 127 | — | 170 | — | — | — | 223 | — | — |
| G | 19.4 | .75 | 1.04 | 16 | — | 26 | — | — | — | — | 81 | — | — | — | 127 |
| H | 16.5 | .69 | .42 | 41 | — | — | — | 98 | — | — | 181 | — | — | — | — |
| Type 316 | | | | 152 | — | 235 | 368 | — | 505 | 987 | — | — | — | — | — |
| Type 310 | | | | 34 | — | 46 | 62 | — | 78 | 108 | — | — | — | 133 | — |
| RA330 | | | | 35 | — | 46 | 67 | — | 77 | — | — | 123 | — | — | — |

TABLE V

Cyclic Oxidation Resistance
Internally Nitrided Ferritic Stainless
(Avg. of Duplicate Coupons on Nitrided Alloys)

Weight Gain (mg./in.$^2$)
Number of Cycles(25 min.heat/5 min.cool at 982° C)

| Heat | Cond.* | 82 | 138 | 265 | 361 | 453 | 594 | 734 | 1019 |
|---|---|---|---|---|---|---|---|---|---|
| A | N | 2.8 | 3.2 | 4.1 | 4.8 | 5.7 | 7.2 | 9.4 | 8.9 |
| | U | 6.7 | 8.5 | 11.6 | 13.5 | 15.3 | 18.1 | 21.5 | 32.7 |
| B | N | 3.4 | 4.0 | 5.2 | 5.7 | 6.0 | 6.8 | 7.8 | 10.4 |
| | U | 5.8 | 7.7 | 9.9 | 11.4 | 12.5 | 14.1 | 15.5 | 17.7 |
| C | N | 3.3 | 3.9 | 5.4 | 6.2 | 7.0 | 8.9 | 11.7 | 16.0 |
| | U | 6.5 | 7.6 | 10.8 | 12.5 | 14.2 | 15.7 | 18.2 | 20.8 |
| D | N | 3.6 | 5.0 | 7.7 | 11.0 | 14.0 | 18.2 | 45.7 | Destroyed |
| | U | 6.0 | 9.0 | 11.8 | 14.2 | 15.3 | 18.4 | 20.9 | 34.3 |
| E | N | 5.6 | 5.4 | 6.4 | 6.9 | 7.5 | 8.3 | 10.5 | 5.0 |
| | U | 7.0 | 9.1 | 13.9 | 15.4 | 18.3 | 19.7 | 23.8 | 29.0 |
| T316 | U | 6.5 | −7.6 | −119.3 | −510.6 | Destroyed | — | — | — |
| T310 | U | 3.2 | 4.3 | 6.9 | −9.0 | −54.9 | −84.9 | −114.2 | −232.9 |
| RA330 | U | 4.0 | 4.7 | 6.7 | 8.0 | 8.1 | 7.1 | 1.2 | −55.3 |

Number of Cycles (25 min.heat/5 min.cool at 900°-1005° C)

| | | 82 | 143 | 282 | 348 | 524 |
|---|---|---|---|---|---|---|
| F | N | 1.4 | 3.5 | 8.1 | 6.9 | 2.2 |
| G | N | 1.9 | 5.3 | 10.0 | 12.2 | 17.0 |
| H | N | 1.2 | 2.9 | 38.8 | 64.0 | −23.1 |

TABLE VI

Chemistry & Bends After Cyclic Oxidation
Internally Nitrided Ferritic Stainless

| Heat | Cond.[1] | Chemistry Increase in Wt.% C | O[2] | N | Bends Minimum L Bend Diameter Before Oxid. Test | After Oxide Test |
|---|---|---|---|---|---|---|
| A | N | .011 | .24 | .046 | 180° - Flat | 180° - 1½T |
| | U | .004 | .29 | .044 | — | 180° - 1T |
| B | N | .001 | .27 | .044 | 180° - 4T | 70°-180°/2½T |
| | U | .007 | .30 | .004 | — | 180° - 1T |
| C | N | .016 | .30 | .106 | 180° - 10T | 10°-180°/2T |
| | U | .003 | .30 | .016 | — | 180° - 1½T |
| D | N | .025 | .31 | .253 | 70 | Destroyed |
| | U | .005 | .30 | .018 | — | 180° - 1½T |
| E | N | .008 | .24 | −.05 | 180° - 3T | 180° - 6T |
| | U | .014 | .27 | .301 | — | 180° - 2½T |
| T310 | U | — | .31 | .08 | 180° - Flat | 180° - Flat |
| T316 | U | — | .31 | .03 | 180° - Flat | 180° - Flat |
| RA330 | U | — | .31 | .06 | 180° - Flat | 180° - Flat |

[1]N-nitrided, U-unnitrided
[2]A base oxygen level of .02% was assumed for unnitrided heats The bend tests indicated that the formability of the nitrided ferritic specimens decreased somewhat, or at best remainded unchanged. The austenitic alloys were still capable of making 180° flat bends. Microscopic examinations revealed the possible presence of internal oxides in the ferritic samples but not in the austenitic samples, and this could account for the somewhat decreased formability of some of the ferritic steels.

The effect of additional cold reduction on nitrided ferritic stainless steels was also investigated. Two heats containing 16.2% chromium, 1.45% titanium, 0.41% silicon, and 21.8% chromium, 0.82%titanium, 0.50% silicon, respectively, were processed to 0.050 inch thickness and subjected to less than complete through-thickness nitriding, viz. about 35–75% nitrided. Samples of these heats were cold reduced to 0.005 inch without difficulty. Other specimens were cold reduced 50% to 0.025 inch thickness, annealed and subjected to sag tests at 982° C. These tests indicated that the sag strength at 0.025 inch was less than that at 0.050 inch thickness, but was still considerably stronger than unnitrided material. From this it was concluded that a fully nitrided ferritic steel in very thin gauges would exhibit good elevated temperature strength, very possibly competitive with Type 310 and RA330.

Autogenous G.T.A. welds were made on a number of nitrided heats. Sound weld bends were then made and compared to the unwelded material. The results indicated that for lower chromium levels ranging between about 16.5 to 17.75%, the welds failed first at an angle far below what was found for unwelded alloys. For chromium contents above 20%, bend failures occurred in the base metal, indicating possible improved weld ductility from dissolving the chromium nitrides found in these alloys. Microscopic examination of some of the welded samples showed a fine precipitate cloud in the heat affected zone but not universally in the columnar weld grains.

All the Heats A-H were melted with amounts of residual elements intentionally added to simulate melting in an A.O. reactor, in order to ascertain whether this affected formability. From the results reported above, it is evident that interstitial levels typical of A.O. reactor melting do not significantly affect the formability of nitrided material.

In the present process the diffusion rate of nitrogen governs the rate of internal nitriding, and hence this rate is parabolically related to time. The depth of internal nitridation can be calculated exactly by a complex equation, but for a majority of practical nitriding conditions (with titanium as an exemplary nitride former) a simplified equation giving accurate values is as follows:

$$\xi = \left[ \frac{2N_N^{(S)} D_N t}{\nu\, 2\, N_{Ti}^{(O)}} \right]^{1/2} \quad (2)$$

where $\xi$ = depth of internal nitridation $N_N^{(S)}$ = mole fraction of nitrogen established at the surface $D_N$ = diffusion coefficient of nitrogen in the region 0 to $\xi$ $t$ = time $N_{Ti}^{(O)}$ = original mole fraction of titanium in the steel $\nu$ = ratio of N atoms to Ti atoms in precipitate = 1.

It is thus evident that the depth of internal nitriding is inversely propotional to the square root of the original titanium content (or other nitride former) and is directly proportional to the square root of the nitrogen in solution at the surface and to the square root of time.

It has been indicated hereinabove that applicants have discovered that an oxide scale, which is subsequently reduced in the nitriding atmosphere, increases the nitriding rate. This phenomenon is believed to be analogous to that explained in detail in U.S. Pat. No. 3,925,579, issued Dec. 9, 1975 to C. Flinchum, F.C. Dunbar and J.L. Arnold.

Since titanium oxide (or oxides of other nitride formers such as zirconium, columbium and vanadium) is much more stable than titanium nitride, conditions may exist where an outer, continuous oxide layer or film forms on the surfaces which cannot be reduced under the conditions of the nitriding heat treatment. The transfer or diffusion of nitrogen through a stable oxide layer is known to be almost negligible, so that the presence of such an oxide adversely affects the nitriding rate. It is difficult to predict a "critical content" of nitride forming element which would result in formation of a stable oxide layer (in the same manner as disclosed in U.S. Pat. No. 3,925,579) since there is a simultaneous competing reaction of the nitride forming element with nitrogen and since the heating rate of the steel to nitriding temperature is slow. During the gradual heating to nitriding temperature both titanium and chromium will oxidize at low temperatures, even if the dew point of the atmosphere is low enough to avoid the formation of iron oxide. However, by the time the steel reaches the nitriding temperature the chromium oxide is no longer stable whereas the titanium oxide remains stable. It is not clear how this reduction of chromium oxide affects the integrity of the remaining titanium oxide, but it has been observed that at nitriding temperatures of less than about 1000° C non-uniform nitriding has occurred, i.e., some regions of a sample showed little or no nitrogen penetration while adjacent regions showed good nitrogen diffusion.

In accordance with the preferred practice of the invention, a brief air anneal (e.g. 5 ∝ 15 minutes at about 900° to 1095° C) apparently causes a thin oxide layer of iron, chromium and titanium to form on the surface. Since this layer is predominantly iron and chromium oxides, most of the oxide is reduced under the nitriding conditions, resulting in an outer layer of reduced metallic iron and chromium with a minor phase of titainum oxide precipitates dispersed uniformly therein. This fresh metallic layer is an excellent site for nitrogen to dissolve and diffuse inwardly. Excellent nitriding rates are thus achieved even at relatively low temperatures or relatively high dew points.

The above findings have been confirmed experimentally, and Table VII summarizes the effect of various surface pretreatments in terms of depth of internal nitriding and amount of nitrogen pick-up. It is evident that optimum results are obtained with an air anneal, although glass bead peening and a dilute nitric acid pickle also result in acceptable nitriding rates.

TABLE VII

EFFECT OF SURFACE PRETREATMENT

COMPOSITION (WT.%) : 20% Cr, 0.9% Ti, 1% Si, balance Fe

NITRIDED at 900° C in 1% $N_2$-99%$H_2$ by volume for 16 hours

| Surface Pretreatment | Depth of Internal Nitriding-Mils | Analyzed Nitrogen Content-wt. percent |
|---|---|---|
| As cold rolled (CR) | 4.7 - 11.8 | 0.13 |
| CR+Glass bead peened (CRP) | 14.9 | 0.14 |
| CRP+10% $HNO_3$ pickle | 16.0 | 0.15 |
| CRP+10% HCl pickle | 0 - 9.4 | 0.08 |
| CRP+10% HF pickle | 0 | 0.02 |
| CR+air anneal 982° C-5 minutes | 18.1 | 0.17 |

It is thus evident that ferritic stainless steels within the composition ranges set forth above can be processed to produce elvated temperature creep strength, oxidation resistance and room temperature formability in combination, at least equivalent to those of the best and far more expensive austenitic stainless steels. More specifically, steels processed in accordance with the invention exhibit a deflection of not greater than 190 mils after 132.5 hours by the 982° C Sag Test described herein, and a weight gain of not greater than 20 mg per square inch after 1019 cycles by the Cyclic Oxidation Resistance Test described herein. Additional advantages inherent in ferritic stainless steels of this invention which cannot be attained in austenitic steels include a low coefficient of thermal expansion, good conductivity and good sulfidation resistance.

The embodiments of the invention in which an exclusive properly or privilege is claimed are defined as follows:

1. Internally nitrided substantially fully ferritic stainless steel cold reduced strip and sheet and products fabricated therefrom comprising a non-hardenable AISI Type 400 series ferritic stainless steel containing a nitride former chosen from the group consisting of titanium, zirconium, hafnium, columbium, vanadium, tantalum and rare earth metals, said nitride former being present in excess of the amount required to react completely with residual nitrogen and carbon in said steel, said excess nitride former being reacted with nitrogen internally to a depth sufficient to obtain an elevated temperature creep strength superior to that of AISI Type 316 austenitic stainless steel, by the 982° C Sag Test defined herein, and an oxidation resistance superior to that of AISI Type 316 austenitic stainless steel, by the Cyclic Oxidation Resistance Test defined herein, said nitrided strip, sheet and fabricated products exhibiting good room temperature formability, substantial freedom from chromium nitrides and chromium oxides, and containing less than about 5% austenite.

2. The strip, sheet and fabricated products claimed in claim 1, wherein said steel comprises, in weight percent, about 16% to about 26% chromium; about 0.4% to about 1.2% silicon; about 0.4% to about 2% total titanium, about 0.25% to about 1.25% of said titanium being in excess of the amount required to react completely with residual nitrogen and carbon; residual carbon, phosphorus, sulfur, nickel, aluminum and molybdenum, and balance iron.

3. The strip, sheet and fabricated products claimed in claim 1, wherein said steel comprises, in weight percent, about 19% to about 21% chromium; about 0.4% to about 0.7% silicon; about 0.25% to about 0.6% titanium in excess of the amount required to react completely with residual nitrogen and carbon; residual carbon, manganese, phosphorus, sulfur, nickel, aluminum and molybdenum, and balance iron, said nitrided strip, sheet and fabricated products containing at least 0.07% nitrogen in the form of a fine dispersion of titanium nitrides.

4. The strip, sheet and fabricated products claimed in claim 2, wherein said excess titanium is substantially fully combined with nitrogen in the form of finely dispersed internal nitrides.

5. The strip, sheet and fabricated products claimed in claim 2, wherein said chromium is at least 17.5% and said silicon is about 1%.

6. The strip, sheet and fabricated products claimed in claim 5, wherein said chromium is about 20.5% maximum.

7. Strip and sheet as claimed in claim 2, wherein said excess titanium is about 0.6% maximum.

8. Fabricated products as claimed in claim 2, wherein said excess titanium is about 1% maximum.

9. The strip, sheet and fabricated products claimed in claim 2, wherein said silicon ranges from about 0.4% to about 0.7%.

10. Internally nitrided substantially fully ferritic stainless steel cast products comprising, in weight percent, about 16% to about 26% chromium, about 0.4% to about 5% silicon; about 0.4% to about 2% total titanium, at least about 0.25% of said titanium being in excess of the amount required to react completely with residual nitrogen and carbon; residual carbon, phosphorus, sulfur, nickel, aluminum and molybdenum, and balance iron; said excess titanium being reacted with nitrogen internally to a depth sufficient to obtain an elevated temperature creep strength superior to that of AISI Type 316 austenitic stainless steel, by the 982° C Sag Test defined herein, an oxidation resistance superior to that of AISI Type 316 austenitic stainless steel, by the Cyclic Oxidation Resistance Test defined herein, said cast products exhibiting substantial freedom from chromium nitrides and chromium oxides, and containing less than about 5% austenite.

11. A method of producing internally nitrided substantially fully ferritic stainless steel strip, sheet and fabricated products having elevated temperature creep strength and oxidation resistance superior to those of AISI Type 316 austenitic stainless steel, by the 982° C Sag Test defined herein, and by the Cyclic Oxidation Resistance Test defined herein, respectively, together with good room temperature formability, comprising the steps of providing a cold reduced substantially fully ferritic non-hardenable AISI Type 400 series stainless steel containing a nitride forming element chosen from the group consisting of titanium, zirconium, hafnium, columbium, vanadium, tantalum and rare earth metals, the nitride-former being present in excess of the amount required to react completely with residual nitrogen and carbon in said steel, and subjecting said strip, sheet and fabricated products to a nitriding heat treatment in a nitrogen-hydrogen atmosphere at a temperature of at least about 800° C but below the temperature at which austenite will form, in accordance with the following equation, wherein titanium is an exemplary nitride forming element:

$$\xi = \left[ \frac{2N_N^{(S)} D_N t}{\nu\, 2\, N_{Ti}^{(O)}} \right]^{1/2}$$

where $\xi$ = depth of internal nitridation $N_N^{(S)}$ = mole fraction of nitrogen established at the surface $D_N$ = diffusion coefficient of nitrogen in the region 0 to $\xi$ $t$ = time $N_{Ti}^{(O)}$ = original mole fraction of titanium in the steel $\nu$ = ratio of N atoms to Ti atoms in precipitate = 1, in such manner as to avoid formation of chromium nitrides, chromium oxides, and austenite, said heat treatment being conducted for a period of time sufficient to cause at least 75% by weight of said excess nitride former to combine with said nitrogen in said atmosphere in the form of microscopic, uniformly dispersed nitrides.

12. The method claimed in claim 11, including the step of subjecting said cold reduced steel to an air anneal at 900° to about 1095° C, and wherein said nitriding heat treatment is conducted with the annealing scale still on the surfaces of said steel.

13. The method claimed in claim 11, wherein said nitriding heat treatment is conducted at a temperature of about 900° to about 950° C with a time at temperature of at least about 5 hours.

14. The method claimed in claim 13, wherein said nitriding heat treatment is conducted in an atmosphere comprising about 1% to about 2% by volume nitrogen and balance essentially hydrogen, with a dew point not higher than about −15° C, for a period of time sufficient to effect complete through-thickness reaction of said nitride former with nitrogen.

15. The method claimed in claim 11, wherein said steel, prior to nitriding, comprises, in weight percent, about 16% to about 26% chromium; about 0.4% to about 1.2% silicon; about 0.4% to about 2% total titanium; about 0.25% to about 1.25% of said titanium being in excess of the amount required to react completely with residual nitrogen and carbon; residual carbon, nitrogen, phosphorus, sulfur, nickel, aluminum and molybdenum, and balance iron.

16. The method claimed in claim 11, wherein said steel, prior to nitriding, comprises, in weight percent, about 19% to about 21% chromium; about 0.4% to about 0.7% silicon; about 0.25% to about 0.6% titanium in excess of the amount required to react completely with residual nitrogen and carbon; residual carbon, nitrogen, manganese, phosphorus, sulfur, nickel, aluminum and molybdenum, and balance iron.

* * * * *